US010989231B2

(12) United States Patent
Wechsel et al.

(10) Patent No.: US 10,989,231 B2
(45) Date of Patent: Apr. 27, 2021

(54) HYDRAULIC VALVE ASSEMBLY WITH FORCED CIRCUIT

(71) Applicant: HAWE HYDRAULIK SE, Aschheim (DE)

(72) Inventors: Thomas Wechsel, Munich (DE); Jean-Michel Sabatier, Ebersberg (DE)

(73) Assignee: HAWE HYDRAULIK SE, Aschheim (DE)

( * ) Notice: Subject to any disclaimer, the term of this patent is extended or adjusted under 35 U.S.C. 154(b) by 286 days.

(21) Appl. No.: 16/272,585

(22) Filed: Feb. 11, 2019

(65) Prior Publication Data

US 2019/0249692 A1 Aug. 15, 2019

(30) Foreign Application Priority Data

Feb. 12, 2018 (DE) ..... 102018202148.1

(51) Int. Cl.
*F15B 13/04* (2006.01)
*F15B 11/20* (2006.01)
(Continued)

(52) U.S. Cl.
CPC ..... *F15B 13/0402* (2013.01); *B66C 13/20* (2013.01); *B66C 13/42* (2013.01);
(Continued)

(58) Field of Classification Search
CPC ..... F15B 20/004; F15B 20/008; F15B 2211/8633; F15B 2211/8643;
(Continued)

(56) References Cited

U.S. PATENT DOCUMENTS 4,425,759 A * 1/1984 Krusche ..... E02F 9/2225 60/420
4,526,085 A * 7/1985 Morizur ..... E02F 9/2239 91/6

(Continued)

FOREIGN PATENT DOCUMENTS

DE 101 27 898 A1 3/2002

OTHER PUBLICATIONS

German Office Action dated Nov. 5, 2018, Application No. 10 2018 202 148.1, Applicant HAWE Hydraulik SE, 7 Pages.

*Primary Examiner* — Craig J Price
(74) *Attorney, Agent, or Firm* — Brooks Kushman P.C.

(57) ABSTRACT

A hydraulic valve assembly includes a first spool valve and a first selector valve for actuating a first hydraulic consumer port or a second hydraulic consumer port, and a second spool valve and a second selector valve for actuating a third hydraulic consumer port or a fourth hydraulic consumer port. A shut-off valve is arranged in a common pressure channel. A branch channel with first and second pressure branch channels branches off the pressure channel upstream of the shut-off valve. The first selector valve connects the first pressure branch channel to a first connection line in a first switching position and connects the second pressure branch channel to a second connection line in a second switching position. The second selector valve, in a first switching position, connects the first connection line to the control channel and, in a second switching position, connects the second connection line to the control channel.

18 Claims, 1 Drawing Sheet

(51) Int. Cl.
*B66C 13/42* (2006.01)
*B66C 13/20* (2006.01)
*F15B 20/00* (2006.01)

(52) U.S. Cl.
CPC ..... *F15B 11/20* (2013.01); *F15B 20/00* (2013.01); *F15B 20/008* (2013.01); *F15B 2211/3056* (2013.01); *F15B 2211/30585* (2013.01); *F15B 2211/30595* (2013.01); *F15B 2211/411* (2013.01); *F15B 2211/41545* (2013.01); *F15B 2211/7142* (2013.01); *F15B 2211/8636* (2013.01); *F15B 2211/8643* (2013.01); *F15B 2211/8752* (2013.01); *Y10T 137/87209* (2015.04)

(58) Field of Classification Search
CPC .. F15B 2211/30585; F15B 2211/30595; F15B 2211/8752; F15B 2211/8755; F15B 13/0402; F15B 11/20; F15B 20/00; F15B 2211/3056; F15B 2211/30583; F15B 2211/411; F15B 2211/41545; F15B 2211/7142; F15B 2211/8636; F15B 2211/8634; F15B 2211/781; F15B 2211/55; F15B 2211/5753; F15B 2211/5756; F15B 2211/763; F15B 11/165; F15B 11/163; F15B 13/028; F15B 2211/8623; F15B 20/002; B66C 13/20; B66C 13/42; Y10T 137/87169–87241
USPC ..... 91/356; 417/278; 60/698–720
See application file for complete search history.

(56) References Cited

U.S. PATENT DOCUMENTS 4,669,363 A * 6/1987 Kreth ..... F15B 11/16 91/189 R
4,738,103 A * 4/1988 Tha ..... E02F 9/2253 60/427
4,875,337 A * 10/1989 Sugiyama ..... F15B 11/16 60/421
4,967,557 A * 11/1990 Izumi ..... E02F 9/2296 60/423
5,193,342 A * 3/1993 Omberg ..... E02F 9/2225 60/426
5,237,908 A * 8/1993 Kropp ..... F15B 11/163 91/518
5,315,828 A * 5/1994 Stellwagen ..... E02F 9/2221 60/426
5,497,805 A * 3/1996 Sunamura ..... E02F 9/22 137/596.16
5,701,933 A * 12/1997 Lunzman ..... E02F 9/2228 137/596.12
6,431,050 B1 8/2002 Hausman et al.
6,715,402 B2 * 4/2004 Pfaff ..... F15B 11/006 91/526
6,769,348 B2 * 8/2004 Hudson ..... E02F 9/2221 60/452
6,837,045 B2 * 1/2005 Heusser ..... B66F 9/22 60/403
7,155,909 B2 * 1/2007 Toji ..... E02F 9/2228 60/468
7,168,246 B2 * 1/2007 Toji ..... E02F 9/2228 60/468
7,182,097 B2 * 2/2007 Busani ..... F15B 13/01 137/596
9,726,203 B2 * 8/2017 Knapper ..... F15B 13/028
2006/0277905 A1 * 12/2006 Matsumoto ..... E02F 9/2292 60/428
2007/0169473 A1 * 7/2007 Esders ..... F15B 11/05 60/422

* cited by examiner

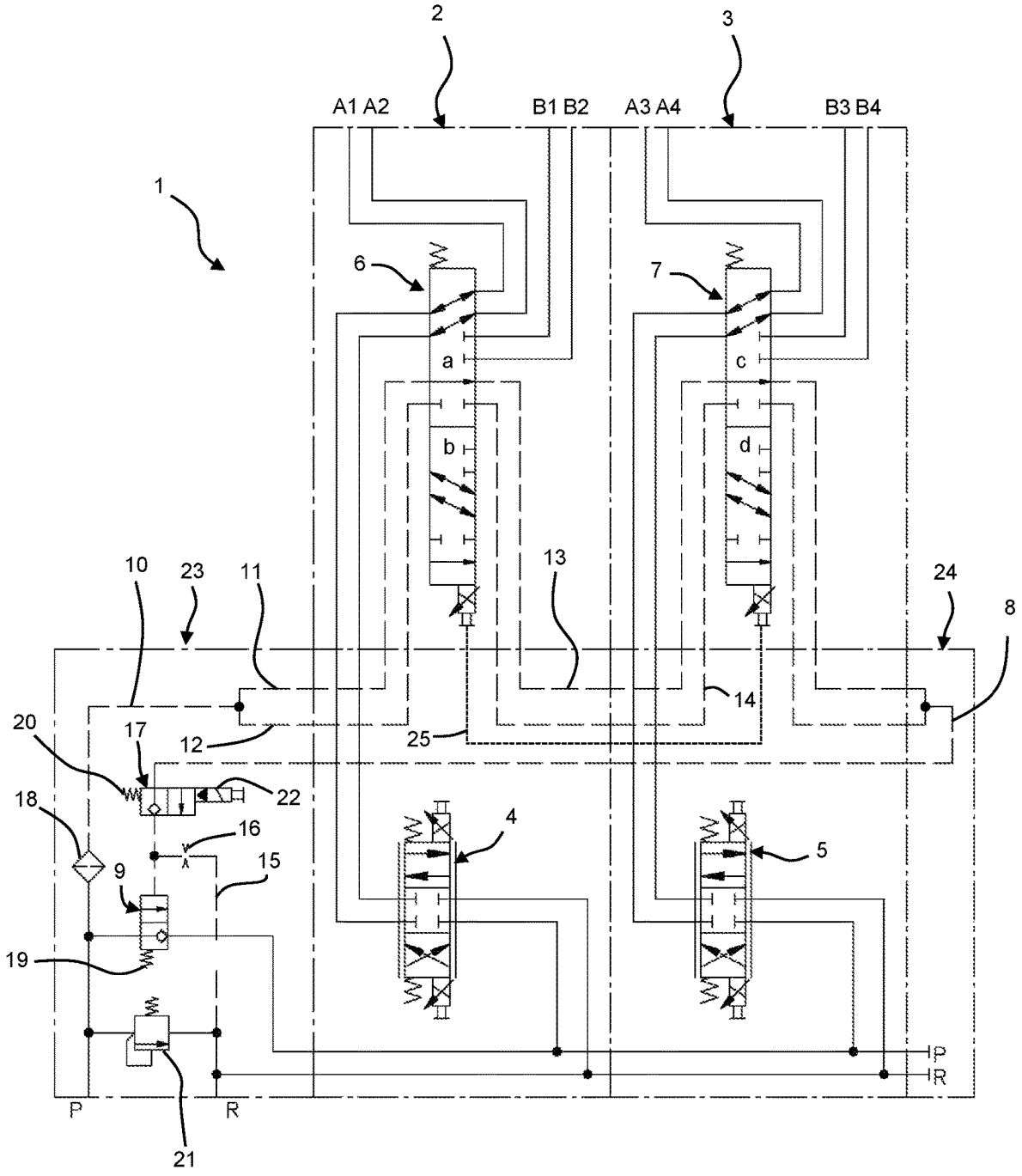
2
3
A1 A2
B1 B2
A3 A4
B3 B4
1
6
7
a
c
b
d
10
23
11
13
24
8
14
20
17
12
25
22
18
16
4
5
9
15
19
P
R
P
R
21

HYDRAULIC VALVE ASSEMBLY WITH FORCED CIRCUIT

CROSS-REFERENCE TO RELATED APPLICATIONS

This application claims foreign priority benefits under 35 U.S.C. § 119(a)-(d) to German patent application number DE 10 2018 202 148.1, filed Feb. 12, 2018, which is incorporated by reference in its entirety.

TECHNICAL FIELD

The present disclosure concerns a hydraulic valve assembly with a forced circuit as well as a mobile hydraulic system with a hydraulic valve assembly according to the disclosure.

BACKGROUND

In mobile hydraulic systems, it often happens that the hydraulic consumers to be controlled are divided into different consumer groups, which are subject to certain actuatability requirements. For safety reasons, among other things, the hydraulic consumers of each of the individual consumer groups should be essentially actuatable in parallel via a hydraulic valve assembly while the other hydraulic consumers of another consumer group should not be actuatable.

These requirements have to be fulfilled in mobile hydraulics, for example in mobile cranes or forestry vehicles, which have retractable and extendable supports as well as a versatile movable mast. For safety reasons, it must be ensured that the mast on such vehicles can only be actuated after the supports have been extended. In addition, the supports must not be retractable while the mast is being operated. This serves to prevent the forestry work vehicle from tipping over, as it is not possible to accidentally retract the supports and destabilize the vehicle while working with the mast.

Conventionally, two hydraulic valve assemblies are used for the implementation. A first hydraulic valve assembly actuates a first group of hydraulic consumers—for example hydraulic cylinders to control the supports—and a second hydraulic valve assembly actuates a second group of hydraulic consumers—for example hydraulic cylinders of the mast. The shut-off between the two hydraulic valve assemblies required for safety reasons is achieved via corresponding shut-off components, for example a shut-off valve.

With these well-known mobile hydraulic systems, however, one hydraulic valve assembly must be provided for each group of hydraulic consumers. It is therefore advisable to connect selector valves downstream of the control devices of the hydraulic valve assembly which, depending on the switching position, enable the first group of hydraulic consumers to be actuated or the second group of hydraulic consumers to be actuated with the same hydraulic valve assembly. This means that such a mobile hydraulic system can be provided without a shut-off component and with only one hydraulic valve assembly.

Nevertheless, it must be ensured that an unintentional actuation of different groups of hydraulic consumers is excluded in the event of a malfunction of the selector valves. For example, a malfunction may occur due to contamination if the selector valves are to be switched synchronously from a first switching position to a second switching position in order to actuate another group of hydraulic consumers, wherein one of the selector valves does not switch to the second switching position but remains in the first switching position. In this case, the supports and the mast can then be unintentionally actuated at the same time.

SUMMARY

In view of this, it is an object of the present disclosure to provide a hydraulic valve assembly for actuating different groups of hydraulic consumers, with which an unintentional simultaneous actuation of two groups of hydraulic consumers is effectively prevented.

The inventive hydraulic valve assembly comprises a first control device with at least a first and a second hydraulic consumer port and a second control device with at least a third and a fourth hydraulic consumer port. The first and third hydraulic consumer ports control a first group of hydraulic consumers (for example hydraulic cylinders for moving the supports) and the second and fourth hydraulic consumer ports control a second group of hydraulic consumers (for example hydraulic cylinders for moving the mast).

In addition, the inventive hydraulic valve assembly has a common pressure channel for supplying pressure to the first and second control devices and a return channel. The first control device comprises a first spool valve and a first selector valve for actuating the first hydraulic consumer port in a first switching position of the first selector valve or the second hydraulic consumer port in a second switching position of the first selector valve. Accordingly, the second control device comprises a second spool valve and a second selector valve for actuating the third hydraulic consumer port in a first switching position of the second selector valve or the fourth hydraulic consumer port in a second switching position of the second selector valve. The first and second spool valves control the corresponding effective consumer volume flow in a conventional way. Preferably, the first spool valve and/or the second spool valve are formed as proportional spool valves.

In accordance with the disclosure, a shut-off valve for interrupting the pressure supply to the first and second control devices is arranged in the pressure channel and pressure pilot-controlled in the opening direction via a control channel, wherein a branch channel having at least one first and at least one second pressure branch channel branches off from the pressure channel upstream of the shut-off valve. According to the disclosure, the first selector valve in the first switching position connects the first pressure branch channel with a first connection line and closes the second pressure branch channel. In the second switching position, the first selector valve connects the second pressure branch with a second connection line and blocks the first pressure branch channel. In the first switching position, the second selector valve connects the first connection line to the control channel and blocks the second connection line. According to the disclosure, the second selector valve in the second switching position connects the second connection line to the control channel and blocks the first connection line.

This results in a forced circuit of the hydraulic valve assembly according to the disclosure. The shut-off valve is kept in the open position by the pump pressure in the control channel when the first selector valve and the second selector valve are in the corresponding switching position by connecting the corresponding pressure branch channel to the control channel via the corresponding connection line. For example, if the first selector valve is in the first switching position and the second selector valve is in the second switching position, the second pressure line on the first selector valve is blocked and the first connection line on the second selector valve is blocked. There is therefore no pump pressure in the control channel. The shut-off valve closes and thus interrupts the pressure supply to the first and second control devices. Thus, in the specific example, no unintentional actuation of the first hydraulic consumer port via the first selector valve and the fourth hydraulic consumer port via the second selector valve can take place.

In addition, the inventive solution has the advantage that the position of the selector valves does not have to be monitored in order to detect a malfunction. In fact, a malfunction can already be detected by the fact that the shut-off valve is switched to the shut-off position.

Of course, the disclosure is not limited to the fact that only two groups of hydraulic consumers can be actuated. Three or more groups of hydraulic consumers can also be actuated. For this purpose, the selector valves must then be designed with a corresponding number of switching positions and the corresponding number of pressure branch channels and connection lines must be provided. In other words, if three groups of hydraulic consumers are to be actuated, the selector valves must be designed with three switching positions and three pressure branch channels and connection lines must be provided. It is advantageous if the first selector valve and/or the second selector valve are spool valves. By using spool valves, more than two switching positions can also be realized for each selector valve, so that more than two hydraulic consumer ports can also be actuated via the respective selector valve. Therefore, several groups of hydraulic consumers can also be actuated separately.

It is suitable if a relief line from the control channel leads into the return channel. The relief line relieves the pressure in the control channel to the return channel, so that a fast and safe response of the shut-off valve is guaranteed.

Preferably a hydraulic resistor is arranged in the relief line. The hydraulic resistor can in particular be a throttle or an adjustable throttle. The hydraulic resistor can be used to precisely define or set when the shut-off valve switches, as a defined relief of the residual pressure remaining in the control channel takes place.

It is advantageous if the shut-off valve is spring-loaded in the shut-off direction. This ensures that the shut-off valve is safely brought into the shut-off position by the spring force in the event of a malfunction.

It is suitable if the shut-off valve is a seated valve. On the one hand, this has the advantage that no leakage flows to the first and second control device due to the seat-tight shut-off. Furthermore, the provision of a seated valve also corresponds to the safety requirement level if the selector valves are designed as spool valves. Thus, it can be largely ruled out that, for example, in the event of a contamination-induced malfunction of the selector valves, a contamination-induced closing error of the shut-off valve may occur.

It may also be advantageous in this context if at least one filter is provided in the branch channel upstream of the first selector valve or one filter is provided in each of the pressure branch channels. This means that contamination-induced malfunctions of the shut-off valve can virtually generally be ruled out.

It is suitable if a closing valve is arranged in the control channel, which can in particular be operated manually. In this way, an "emergency stop" can be implemented quickly and easily. It is conceivable that the closing valve has an electromagnet which, when energized, holds the closing valve in the open position against a spring force. By manually interrupting the power supply, the closing valve closes and thus interrupts the pressure supply to the shut-off valve. The shut-off valve thus goes into the shut-off position, so that the overall pressure supply to the first and second control devices is interrupted.

It is advantageous if the first selector valve and the second selector valve are coupled so that the first selector valve and the second selector valve can each be switched together to the respective first switching position or second switching position. The coupling can be, for example, an electronic coupling, a hydraulic coupling or a mechanical coupling. This synchronous switching of the first selector valve and the second selector valve further reduces the risk of malfunction.

Furthermore, the disclosure concerns a mobile hydraulic system with a hydraulic valve assembly according to the disclosure. The mobile hydraulic system may be a mobile hydraulic system of a utility vehicle, for example a mobile crane or a forestry vehicle.

In the following, an embodiment according to the disclosure is explained in more detail with reference to the FIGURE. Herein it is shown schematically.

DESCRIPTION OF THE DRAWING

THE FIGURE shows a hydraulic circuit diagram of a hydraulic valve assembly according to the disclosure.

DETAILED DESCRIPTION

The illustrated hydraulic valve assembly 1 has a first control device 2 and a second control device 3. The first control device 2 has a total of four hydraulic consumer ports A1, A2, B1 and B2. The effective consumer volume flow is controlled via a first proportional spool valve 4 and a first selector valve 6. For this, the first control device 2 is supplied with pump pressure via a common pressure channel P.

In the illustrated first switching position a of the first selector valve 6, a first group of hydraulic consumers connected to the hydraulic consumer ports A1, A2 can be actuated via a corresponding displacement of the first proportional spool valve 4. Depending on the displacement of the first proportional spool valve 4, the hydraulic consumer port A1 or A2 is pressurized from the pressure channel P or relieved to the tank via a return channel R. By switching the first selector valve 6 to the second switching position b, a second group of hydraulic consumers connected to the hydraulic consumer ports B1, B2 can be actuated accordingly.

Accordingly, the second control device 3 also has four hydraulic consumer ports A3, A4, B3, and B4 as well as a second proportional spool valve 5 and a second selector valve 7. The function of the second control device 3 is the same as that of the first control device 2. When the second selector valve 7 is, as shown, in the first switching position c, a first group of hydraulic consumers connected to the hydraulic consumer ports A3, A4 can be actuated. By switching the second selector valve 7 to the second switching position d, a second group of hydraulic consumers connected to the hydraulic consumer ports B3, B4 can be actuated accordingly.

The first group of hydraulic consumers connected to the hydraulic consumer ports A1, A2, A3 and A4 can be designed, for example, to control the supports of a mobile crane. Therefore, the hydraulic consumers of the second group connected to the hydraulic consumer ports B1, B2, B3 and B4 can be designed, for example, to control the mast of the mobile crane. To switch between the groups to be actuated, the first selector valve 6 and the second selector valve 7 are each designed as spool valves, in particular as 10/2 spool valves.

In order to prevent the simultaneous actuation of hydraulic consumers of the first and second group due to a malfunction of the first selector valve 6 or the second selector valve 7, hydraulic valve assembly 1 has a forced circuit. For this purpose, a pressure pilot-controlled shut-off valve 9 is provided in the common pressure channel P upstream of the first and second proportional spool valves 4, 5 to interrupt the pressure supply of the first control device 2 and the second control device 3. The shut-off valve 9 acts as a pressure channel shut-off and is spring-loaded in the shut-off direction by a spring 19 and can be pressurized in the opening direction by a control channel 8.

There is pressure in control channel 8 when the first selector valve 6 and the second selector valve 7 are each in the same switching position, that means when both selector valves 6, 7 are either both in the first switching position a, c or both in the second switching position b, d. For this purpose, a branch channel 10 branches off from the pressure channel P upstream of the shut-off valve 9. Branch channel 10 is divided, as shown, into a first pressure branch channel 11 and a second pressure branch channel 12. If the first selector valve 6 is, as shown, in the first switching position a, the first pressure branch channel 11 is connected to a first connection line 13. The second pressure branch channel 12 is blocked in the first switching position a of the first selector valve 6.

Accordingly, the first connection line 13 in the first switching position c of the second selector valve 7 is connected to control channel 8 so that the pressure applied to the branch channel 10 via control channel 8 keeps the shut-off valve 9 open against the spring force of the spring 19. If the first selector valve 6 and the second selector valve 7 are now each switched to the second switching position b, d, the first selector valve 6 connects the second pressure branch channel 12 with a second connection line 14. The first pressure branch channel 11 is blocked at the first selector valve 6. The second connection line 14 is then connected to the control channel 8 via the second selector valve 7, while the first connection line 13 is blocked at the second selector valve 7.

If the first selector valve 6 and the second selector valve 7 are not in the same switching position, branch channel 10 is not connected to control channel 8. In this case, the shut-off valve 9 moves to the shut-off position due to the spring force of the spring 19. In order to relieve the possibly existing pressure in control channel 8, a relief line 15 branches off from control channel 8 and flows into return channel R. A hydraulic resistor in the form of a throttle 16 is arranged in relief line 15. Via this defined relief of the control channel 8 into the return channel R, the remaining residual pressure in the control channel 8 is reduced so that a safe response or switching of the shut-off valve 9 is guaranteed. It is, of course, also conceivable in this context that throttle 16 is designed as an adjustable throttle.

For safety reasons, the shut-off valve 9 is designed as a seated valve. Thus, the shut-off valve 9 is not designed as a spool valve like the first and second selector valves 6, 7. In order to further prevent a malfunction of the shut-off valve 9, a filter 18 is arranged in branch 10.

In addition, a closing valve 17 is arranged in control channel 8 upstream of the branch of the relief line 15. The closing valve 17 has an electromagnet 22 acting in the opening direction which holds the closing valve 17 open against the spring force of a spring 20 when energized. The current supply to the electromagnet 22 can be interrupted manually so that the closing valve 17 closes control channel 8 due to the spring force of spring 20. Consequently, the residual pressure is relieved via the relief line 15 to the return channel R and the shut-off valve 9 interrupts the pressure supply to the first and second control devices 2, 3. Closing valve 17 thus represents an easy-to-implement "emergency stop". In addition, there is also the advantage that in the event of a power failure of the mobile hydraulics, the closing valve 17 also closes control channel 8, thus interrupting the pressure supply to the first control device 2 and the second control device 3.

In the embodiment shown in the FIGURE, the first selector valve 6 and the second selector valve 7 are actuated via corresponding electromagnets. The electromagnets are controlled via a coupling 25, which is indicated as a dotted line in the FIGURE. Thus, the first selector valve 6 is always switched synchronously with the second selector valve 7. It is of course also conceivable that the coupling 25 is a mechanical or hydraulic coupling.

As shown, the hydraulic valve assembly 1 has a modular design and can therefore be extended accordingly. In particular, it is evident that the first control device 2 and the second control device 3 are completely identical. The first control device 2 and the second control device 3 are designed as valve segments which together with a connection block 23 and an end plate 24 form the hydraulic valve assembly 1. The shut-off valve 9, the branch channel 10 and the closing valve 17 are arranged in connection block 23. In addition, a pressure relief valve 21 is arranged in connection block 23, which relieves the pressure channel P to the return channel R at a certain limit pressure. The end plate 24 serves to connect the corresponding lines of the second control device 3 to the control channel 8.

Thus, the inventive hydraulic valve assembly 1 can easily be supplemented by further control devices. Furthermore, the disclosure is not limited to the fact that only two groups of hydraulic consumers can be actuated. Three or more groups of hydraulic consumers can also be actuated. For this purpose, the selector valves may then be designed with a corresponding number of switching positions and the corresponding number of pressure branch channels may be provided. In other words, if three groups of hydraulic consumers are to be controlled, the selector valves may be designed with three switching positions and three pressure branch channels may be provided.

What is claimed is:

1. A hydraulic valve assembly comprising:

a first control device with first and second hydraulic consumer ports;

a second control device with third and fourth hydraulic consumer ports;

a common pressure channel for supplying pressure to the first and second control devices; and a return channel;

wherein the first control device has a first spool valve and a first selector valve for actuating the first hydraulic consumer port in a first switching position of the first selector valve or the second hydraulic consumer port in a second switching position of the first selector valve;

wherein the second control device has a second spool valve and a second selector valve for actuating the third hydraulic consumer port in a first switching position of the second selector valve or the fourth hydraulic consumer port in a second switching position of the second selector valve;

wherein a shut-off valve for interrupting the pressure supply to the first and second control devices is arranged in the pressure channel and pressure pilot-controlled in an opening direction via a control channel;

wherein upstream of the shut-off valve a branch channel with first and second pressure branch channels branches off from the pressure channel;

wherein the first selector valve in the first switching position connects the first pressure branch channel to a first connection line and blocks the second pressure branch channel, and in the second switching position connects the second pressure branch channel to a second connection line and blocks the first pressure branch channel; and wherein the second selector valve in the first switching position connects the first connection line to the control channel and blocks the second connection line, and in the second switching position connects the second connection line to the control channel and blocks the first connection line.

2. The hydraulic valve assembly according to claim 1, wherein the first selector valve and/or the second selector valve are spool valves.

3. The hydraulic valve assembly according to claim 1 further comprising a relief line that leads from the control channel into the return channel.

4. The hydraulic valve assembly according to claim 3 further comprising a hydraulic resistor arranged in the relief line.

5. The hydraulic valve assembly according to claim 1, wherein the shut-off valve is spring-loaded in the shut-off direction.

6. The hydraulic valve assembly according to claim 1, wherein the shut-off valve is a seated valve.

7. The hydraulic valve assembly according to claim 1 further comprising a closing valve arranged in the control channel.

8. The hydraulic valve assembly according to claim 7, wherein the closing valve can be operated manually.

9. The hydraulic valve assembly according to claim 1, wherein the first selector valve and the second selector valve are coupled so that the first selector valve and the second selector valve can each be switched together to the respective first switching position or second switching position.

10. A mobile hydraulic system comprising the hydraulic valve assembly according to claim 1.

11. A hydraulic valve assembly comprising:

a first control device with first and second hydraulic consumer ports, wherein the first control device has a first spool valve and a first selector valve for actuating the first hydraulic consumer port in a first switching position of the first selector valve or the second hydraulic consumer port in a second switching position of the first selector valve;

a second control device with third and fourth hydraulic consumer ports, wherein the second control device has a second spool valve and a second selector valve for actuating the third hydraulic consumer port in a first switching position of the second selector valve or the fourth hydraulic consumer port in a second switching position of the second selector valve;

a common pressure channel for supplying pressure to the first and second control devices;

a shut-off valve arranged in the pressure channel for interrupting the pressure supply to the first and second control devices, wherein the shut-off valve is pressure pilot-controlled in an open direction via a control channel; and a branch channel that branches off the pressure channel upstream of the shut-off valve and that includes first and second pressure branch channels;

wherein the first selector valve in the first switching position connects the first pressure branch channel to a first connection line and blocks the second pressure branch channel, and in the second switching position connects the second pressure branch channel to a second connection line and blocks the first pressure branch channel; and wherein the second selector valve in the first switching position connects the first connection line to the control channel and blocks the second connection line, and in the second switching position connects the second connection line to the control channel and blocks the first connection line.

12. The hydraulic valve assembly according to claim 11, wherein the first selector valve and/or the second selector valve are spool valves.

13. The hydraulic valve assembly according to claim 11, wherein the shut-off valve is spring-loaded in the shut-off direction.

14. The hydraulic valve assembly according to claim 11, wherein the shut-off valve is a seated valve.

15. The hydraulic valve assembly according to claim 11 further comprising a closing valve arranged in the control channel.

16. The hydraulic valve assembly according to claim 15, wherein the closing valve can be operated manually.

17. The hydraulic valve assembly according to claim 11, wherein the first selector valve and the second selector valve are coupled so that the first selector valve and the second selector valve can each be switched together to the respective first switching position or second switching position.

18. A mobile hydraulic system comprising the hydraulic valve assembly according to claim 11.

* * * * *